United States Patent [19]

Foreman et al.

[11] 4,124,540

[45] Nov. 7, 1978

[54] RESISTIVE ELECTRICAL CONDUCTIVE COATING FOR USE IN A CATHODE RAY TUBE

[75] Inventors: Gordon T. Foreman, Seneca Falls; Anthony V. Gallaro, Auburn; George N. Williams, Seneca Falls, all of N.Y.

[73] Assignee: GTE Sylvania Incorporated, Stamford, Conn.

[21] Appl. No.: 813,087

[22] Filed: Jul. 5, 1977

Related U.S. Application Data

[63] Continuation of Ser. No. 739,023, Nov. 4, 1976, abandoned, which is a continuation-in-part of Ser. No. 600,902, Jul. 31, 1975, abandoned.

[51] Int. Cl.[2] ..... H01B 1/08

[52] U.S. Cl. ..... 252/518; 106/53; 313/479; 313/480; 313/450

[58] Field of Search ..... 252/518; 106/53; 313/479, 480, 450

[56] References Cited

U.S. PATENT DOCUMENTS

| | | | |
|---|---|---|---|
| 3,959,686 | 5/1976 | Davis et al. | 313/479 X |
| 3,974,107 | 8/1976 | Carcia | 252/518 X |
| 4,018,717 | 4/1977 | Francel et al. | 252/518 X |

FOREIGN PATENT DOCUMENTS 1,274,520 5/1972 United Kingdom.

*Primary Examiner*—Benjamin R. Padgett
*Assistant Examiner*—E. Suzanne Parr
*Attorney, Agent, or Firm*—Thomas H. Buffton

[57] ABSTRACT

A high resistive electrical conductive coating of discrete composition is provided for band-like deposition in a defined area of the interior surface of substantially the funnel member of a cathode ray tube envelope between the region of the high potential transversal therethrough and the electron generating means oriented in the contiguous neck portion. The coating is an amorphous deposition of a homogeneous mixture of a vitreous substantially insulative frit material admixed with at least one particulate material selected from the group consisting essentially of cadmium oxide, indium oxide and copper oxide wherein the individual particles of the respective oxide ingredients are uniformly dispersed and encapsulated to provide a discretely defined resistive structural means for effecting arc suppression in the region of the electron generating assembly.

4 Claims, 1 Drawing Figure

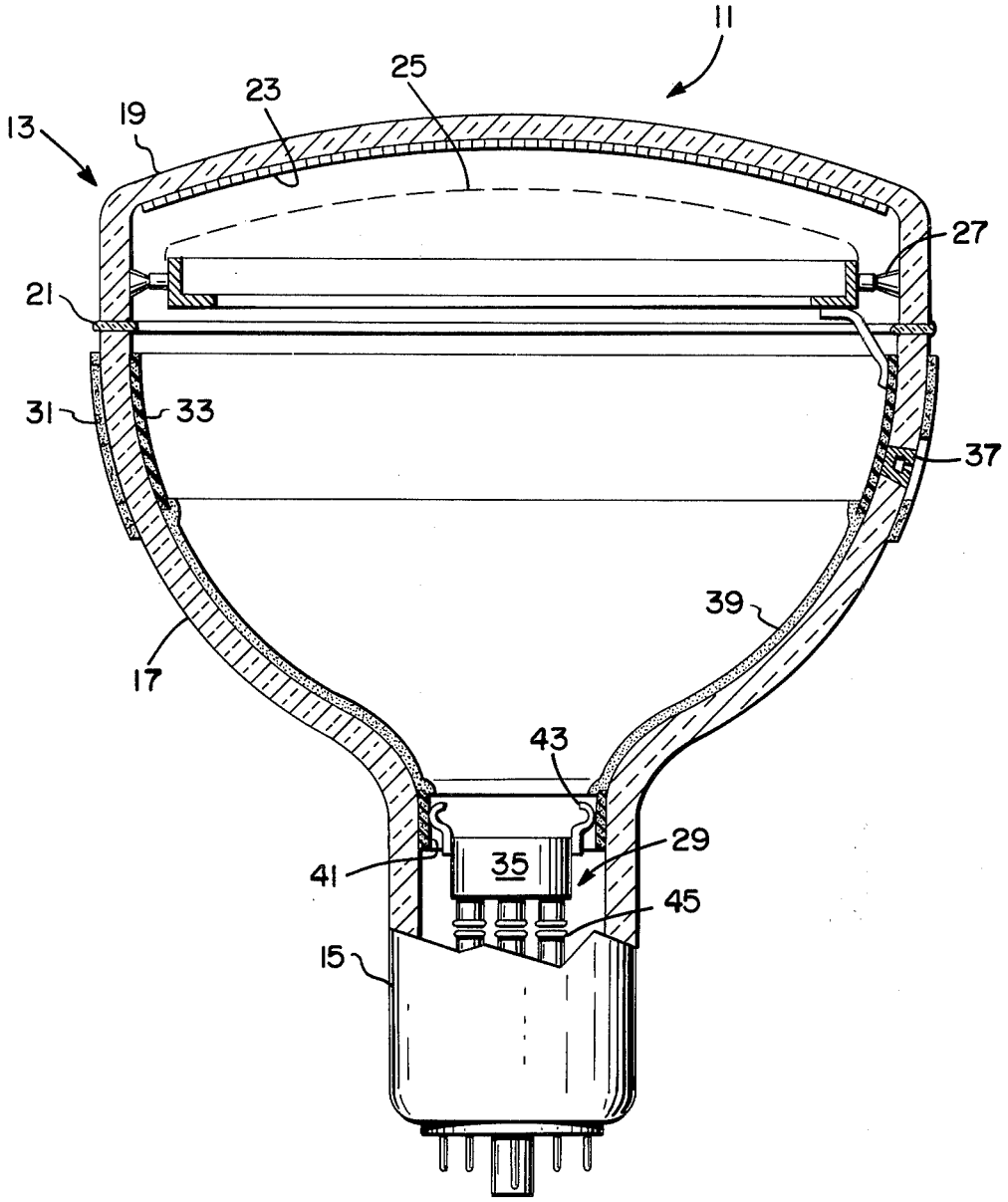
11
25
23
19
13
27
21
31
33
37
39
17
43
29
41
35
45
15

RESISTIVE ELECTRICAL CONDUCTIVE COATING FOR USE IN A CATHODE RAY TUBE

CROSS REFERENCE TO RELATED APPLICATION

This application is a continuation of Ser. No. 739,023 filed Nov. 4, 1976, now abandoned, and incorporates by reference the disclosure set forth in that application. Ser. No. 739,023 was a continuation-in-part of the parent case Ser. No. 600,902, filed July 31, 1975, and now abandoned. Application Ser. No. 739,023 contained matter disclosed but not claimed in a related application, Ser. No. 738,728, filed Nov. 4, 1976, now abandonded such being a continuation-in-part of Ser. No. 600,784 filed July 31, 1975, now abandoned. Filed concurrently with Ser. No. 739,023 was a related application, Ser. No. 738,729, filed Nov. 4, 1976, now abandoned and assigned to the assignee of the noted applications.

A co-pending application Ser. No. 683,647, filed May 6, 1976, now abandoned and assigned to the assignee of the present invention is a division of Ser. No. 600,784 containing matter disclosed but not claimed therein.

BACKGROUND OF THE INVENTION

This invention relates to cathode ray tube construction and more particularly to a high resistive electrical conductive coating employed for suppressing deleterious arcing therein.

The advancement of cathode ray tube technology has resulted in marked improvements in both tube construction and the operational considerations relating thereto, including a trend toward the utilization of higher screen potentials along with the miniaturization and compaction of associated electron gun structures encompassed within the envelope neck portions of smaller diameters. Consequently, spacings between related electrode components in the electron gun structure of the tube have been reduced in keeping with advanced design parameters. The minuteness of these interelectrode spacings, in conjunction with the high voltage differential existant within the tube, and the presence of possible contaminants, increases the probability of dielectric breakdown within the tube structure.

It has been conventional practice in cathode ray tube construction to apply an electrical conductive coating on the interior surface of the funnel member of the tube envelope in a manner to extend from substantially the vicinity of the cathodoluminescent screen into the forward region of the adjoining neck member. This coating, which usually has a high positive electrical potential applied thereto, via connective means traversing the wall of the funnel member, serves as a connective medium conveying a high electrical potential of substantially a common value to both the screen and the terminal electrode of the electron gun assembly oriented within the neck member of the tube envelope. Thus, the condition is present for the possible generation of a spark discharge between the terminal electrode and the adjacent lower voltage electrode in the gun assembly, especially in the presence of aggravating elements such as sublimation deposits, foreign particles, and minute projections extending into the inter-electrode spacings. While considerable effort is expended during tube manufacturing to minimize the factors contributing to dielectric breakdown, the utilization of anode potentials in the order of 30 KV and higher makes the possible presence of contributable arcing conditions factors of extreme importance. Arcing or dielectric breakdown within the cathode ray tube has always been an undesired probability, the magnitude of which has been found to sometimes exhibit destructive intensities of 100 amperes or more. With the increased employment of solid state components in television and allied display devices, arcing within the cathode ray tube can produce catastrophic effects on the vulnerable components in the externally associated operating circuitry. Additionally, an arc discharge initiated within the tube may seriously damage the internal structure thereof and resultantly promote leakage through the sublimation of deleterious metallic deposits on related surfaces in the region of the gun structure.

Cleanliness, precision, vigilance and care in the tube manufacturing process are ever continuing procedures employed to combat the materializing of conditions conductive for arcing. Nevertheless, human factors, processing sublimates, manufacturing tolerances and procedural variations may combine to produce an undesirable and aggravative situation. The discrete use of high resistance coatings on defined interior areas of the funnel member of the envelope has been tried. For example, one such technique is that disclosed by A. V. de Vere Krause in U.S. Pat. No. 2,829,292, wherein a band of resistive coating is internally applied to substantially the juncture region of the funnel and neck members of the tube envelope whereat the snubbers on the terminal electrode of the electron generating assembly make plural-point contact with the high resistance arcing to limit the spark discharge current in the region of the electron gun. However, it has been found in high anode potential tubes that the assembly snubbers tend to effect high resistance point contact with the resistive coating, a condition which is prone to produce intense heat during tube processing when a high voltage conditioning potential of 40 KV or more may be applied to the anode. Such localized heating may cause a buildup of deleterious field emission, ionization and ultimate rupture or checking of the glass wall of the neck member. Additionally, difficulties have been encountered in achieving high resistive electrical conductive coatings that evince uniformity, consistently exhibit the desired electrical characteristics and manifest the necessary tenacious bonding to the surface of the envelope. Since the minimization and eliminating of arcing in present-day color cathode ray tubes is assuming ever increasing importance, it is a prime concern in tube manufacturing to achieve an expedient and consistent coating means for adequately controlling the probable arcing environment within the cathode ray tube per se.

OBJECTS AND SUMMARY OF THE INVENTION

It is an object of this invention to reduce and obviate the aforementioned disadvantages that are evidenced in the prior art. Another object of the invention is to provide improved resistive coating means for consistently effecting improved internal arc suppression within a cathode ray tube. It is a further object of the invention to provide improved arc suppression within a cathode ray tube by utilizing an improved and discretely constituted high resistive electrical conductive coating that is capable of being disposed on the wall of the envelope in an expedient and economical manner during tube manufacturing.

These and other objects and advantages are achieved in one aspect of the invention wherein improved arc suppression within a cathode ray tube is achieved by disposing a high resistive electrical conductive coating on a portion of the interior surface of the envelope intermediate a forwardly-oriented first low resistive coating and a rearwardly-oriented second low resistive coating disposed in the neck region forward of the electron generating assembly. The high resistive coating of the invention is comprised of an amorphous deposition of a homogeneous mixture of a vitreous frit material admixed with at least one particulate material selected from the group consisting essentially of cadmium oxide, indium oxide and copper oxide. The frit component of the mixture has a softening point in the range of substantially 350°–450° C. and a coefficient of expansion compatible with the glass composition of the envelope portion upon which the mixture is adhered. The amount of frit material in the deposition is within the range of substantially 35 to 65 percent by weight of the mixture depending upon the frit material utilized wherein the individual particles of the respective oxide or oxides are uniformly dispersed and substantially encapsulated.

BRIEF DESCRIPTION OF THE DRAWINGS

The single FIGURE is a cross-sectional elevation of a cathode ray tube wherein an exemplary embodiment of the improved and discretely constituted high resistive coating of the invention is disposed.

DESCRIPTION OF THE PREFERRED EMBODIMENT

For a better understanding of the present invention, together with other and further objects, advantages, and capabilities thereof, reference is made to the following specification and appended claims in connection with the aforedescribed drawing.

While the invention is applicable for utilization in conventional cathode ray tubes employed in both monochrome and color television application and allied image reproducing systems, for purposes of illustration, a color cathode ray tube utilizing a multi-apertured shadow mask and a plural beam electron generating assembly will be described in this specification.

With particular reference to the drawing, a plural beam color cathode ray tube 11 is illustrated as having an envelope 13 comprised of an integration of neck 15, funnel 17, and viewing panel 19 members; whereof the panel member and the integrated funnel-neck section are hermetically joined by frit sealing during tube fabrication along a congruent sealing region 21 therebetween. A patterned cathodoluminescent screen 23, of diverse color-emitting phosphor areas, is formed on the interior surface of the viewing panel as an array of definitive stripes or dots, in keeping with the known state of the art. A multi-apertured structure 25, in this instance a shadow mask, having openings discretely shaped in keeping with the pattern of the screen, is oriented within the viewing panel by a plurality of locator means 27, in spatial relationship to the patterned screen therein.

An exemplary and partially detailed plural beam electron generating assembly 29 is positioned within the neck member of the envelope and oriented to project a plurality of electron beams in a manner to effect convergence at the apertured mask 25 and thence impinge the patterned screen 23 therebeyond.

It has been conventional practice to dispose electrical conductive coatings on both the interior and exterior surfaces of the funnel member of the tube. These coatings in conjunction with the intervening glass wall of the funnel form a capacitive filtering effect which is utilized in the operational circuitry of the associated television or image display device. The exterior coating 31 on the funnel member is an electrical conductive material, such as Aquadag, and is disposed on a portion of the external surface thereof extending from substantially the region adjacent the panel-funnel seal 21 to approximately the mid-region of the funnel 17.

In the example shown, the interior surface of the funnel member has a tripartite electrical connective-resistive system discretely disposed thereon whereof a first low resistive electrical conductive coating 33, such as an Aquadag composition, is applied in a substantially perimetrical manner on the forward areal portion thereof proximal to the sealing region 21. An electrical potential, for both the screen 23 and the terminal electrode member 35 of the electron generating assembly 29, is applied to this carbonaceous coating composition via a funnel-disposed electrical transversal or connective button 37. Circumferentially contiguous with the rear boundary of the first low resistive coating 33, is a high resistive electrical conductive coating composition 39 of substantially a glass and metal oxide mixture which is uniformly disposed and tenaciously bonded in a substantially perimetrical manner to the interior surface of substantially the rearward portion of the funnel. This high resistive coating is disposed as a skirt-like formation which extends to substantially the neck member 15 whereat it makes contact with a narrow defined band of a second low resistance coating 14 that exhibits scratch resistant characteristics and tight adherence to the glass. This second coating serves as a buss-bar connector providing an area of contact for the multiple contacting elements or snubbers 43 associated with the terminal electrode of the electron generating assembly 29 oriented within the neck member of the envelope.

In a typical electron generating assembly the operational high positive voltage of the anode or terminal electrode 35 may be of a potential in the order of 30 KV or more, applied through the funnel-wall transversal button 37, while the voltage on the adjacent focusing electrode 45 in the assembly 29 is within the range of about 17 to 20 percent of the anode voltage. Thus, it is highly desirable to employ current-limiting and arc-inhibiting coating means within the cathode ray tube envelope.

The tripartite connective-resistive system, provided by the respective electrically related coatings 33, 39 and 41, disposed on the interior surface of the envelope provides an electrical conductive path incorporating a low voltage DC resistance of a value preferably in the multi-megohm range. It has been found that resistance values of this size markedly limit the current and inhibit the initiation of possible deleterious arcing in vulnerable regions. In tubes employing the tripartite combination of coatings as described and shown, the peak arcing currents are significantly reduced to non-destructive magnitude.

In greater detail, the first low resistive conductive coating 33 of the tripartite electrical conductive system is forwardly oriented on the funnel member 17, and may be a conventional carbonaceous coating composition such as Aquadag in conjunction with a water base potassium or sodium silicate binder. This coating is representative of the type commonly disposed on the interior of the funnel and may be applied in a perimetrical manner during funnel preparation by spraying or brushing techniques practiced in the art. While this particular coating may manifest limited scratch resistance, in this instance it is restricted to a region of the funnel whereat there is a minimum risk of accidental abrasion.

The improved high resistive coating 39 of the invention is applied to a discrete area of the funnel as a perimetrical deposition contiguous to and rearward to the first low resistive coating 33, extending therefrom to the neck member 15. This high resistive coating 39 is an amorphous deposition of a homogeneous mixture of a vitreous frit material admixed with at least one particulate material selected from the group consisting essentially of cadmium oxide, indium oxide and copper oxide. Broadly, the frit component exhibits insulative characteristics, a softening point in the range of substantially 350° to 450° C. and a coefficient of expansion compatible with that of the glass composition of the envelope portion to which the deposition is applied. An amorphous vitreous glass is one that retains its glassy structure and does not exhibit devitrification or crystallization during heat transformation. Such glasses applicable to this invention are those, for example, comprised principally of substantially 70 to 85 weight percent PbO, 5 to 15 weight percent $B_2O_3$, 2 to 10 weight percent $Al_2O_3$, and 3 to 5 weight percent $SiO_2$. Appropriate examples of suitable frit materials of this type are glass solder frits designated as No. 8463 and No. 7570 respectively, such being commercially available from the Corning Glass Works, Corning, N.Y. These solder glass materials are low melting temperature amorphous vitreous compositions that are completely compatible with the glass of the funnel member. The No. 8463 material is representative of a low melting frit composition having a softening temperature in the order of 370° C.; while the No. 7570 frit is one exhibiting a softening temperature in the order of 440° C. Another exemplary material intermediate to the aforementioned, is one such as frit No. 7555 which has a softening point of substantially 410° C.

An example of the improved current limiting high resistive composition of the invention is achieved by homogeneously admixing one or more of the previously defined particulate oxides, which are inherently electrically conductive, with one of the aforementioned powdered vitreous insulative frit materials. It has been found that the particle sizes of the constituent materials are important in achieving a mixture wherein the particles of, for instance, cadmium oxide are subsequently homogeneously embedded in and substantially encapsulated with glass to provide a resultant tightly-adherent coating exhibiting consistent resistive-conductive characteristics throughout the bulk of the deposition. The particle size distribution of the respective powdered vitreous frit material is within the range of substantially 1.0 to 35.0 microns in size, while the particulate cadmium oxide is of a size distribution within the range of substantially 1.0 to 10.0 microns in size.

An exemplary homogeneous mixture of the particulate components is constituted whereof the No. 7570 vitreous frit material is preferably within the range of substantially 50 to 65 weight percent and the admixed cadmium oxide preferably within the range of substantially 35 to 50 weight percent. The resistive value of the composition can be modified by adjusting the proportions of the frit material and the oxide within the ranges indicated. To effect desired adherence, the amount of the No. 7570 frit material should be at least 50 weight percent of the deposition. For example, a mixture of substantially 60 to 65 weight percent of frit material and substantially 35 to 40 weight percent of cadmium oxide disposed as a 3 to 5 mils finished thickness will provide excellent adherence and an adequate resistance of approximately 2 megohms.

In utilizing the No. 8463 vitreous frit material in the homogeneous mixture, the frit component is preferably within the range of substantially 35 to 45 weight percent and the exemplary cadmium oxide preferably within the range of substantially 55 to 65 weight percent. Modification of the resistive value of the mixture can be achieved by adjusting the proportions of the oxide and frit material within the ranges indicated.

The desired proportions of the respective frit and oxide powdered materials are admixed with a liquid vehicle, compatible with the internal cathode ray tube environment, such as an organic binder which may be a frit lacquer, having exemplary 0.1 to 0.5 weight percent of solids therein, as for example, a solution of 1 percent nitrocellulose dissolved in an ester, such as amyl acetate. This frit-metal-oxide-vehicle combination, being of substantially viscous consistency, is then subjected to a rolling mixing procedure to achieve a homogeneous suspension of the solids therein; whereupon a quantity of diluent preferably having a boiling point higher than that of the lacquer solvent, such as diethyl oxalate, which is compatible with the ester of the organic binder, is admixed to provide the proper viscosity for application and afford adequate drying control. For example, for brush application a viscosity in the order of substantially 300 to 1000 centipoise is appropriate while for spray deposition a viscosity of substantially 150 centipoise is suitable.

The next component of the tripartite system, the second low resistive electrical conductive coating 41 is disposed as a narrow circumferential band in the forward region of the neck member 15 making contact with the rear boundary of the high resistive coating 39. This band is of a width much less than that of the high resistive deposition and provides a buss-bar conductive medium for effecting advantageous connection with the contacting elements 43 terminally oriented on the electron generating assembly 29 whereby undesired high resistance points of contact therebetween are avoided, thusly eliminating harmful localized points of abnormal heating during subsequent high voltage tube processing and conditioning. The band, being less than substantially 1 inch in width, is located in the neck region, whereat it affords contact and spatial association with substantially only the contact elements of the electron generating assembly. The composition of the conductive band is such as to effect a resistance in the order of substantially 500 to 2000 ohms per inch, and for example, may be comprised of a modified conductive carbonaceous material, such as graphite or Aquadag, admixed with a compatible substantially inert fine particulate material, such as ferric oxide, chromic oxide and aluminum oxide, and a suitable aqueous base silicate binder. An exemplary composition suitable for forming a conductive band exhibiting tight adherence a hard scratch-resistant and particle-free surface and the desired conductive properties is one substantially comprised of:

50 weight percent of at least one of the above-mentioned oxide ingredients 30 weight percent of water base Aquadag (30 percent solids)

20 weight percent of water base potassium silicate (35 percent solids)

Such is applied, such as by brushing, to the discrete areal region of the neck as described and shown.

The tripartite connective-resistive system is disposed by a method wherein the first and second low resistive electrical conductive coatings 33 and 41 are suitably applied by conventional means to the respective separated envelope areas as previously described and shown, whereupon they are subjected to drying. The high resistive electrical conductive coating 39 is then applied to the intervening area between the respective first 33 and second 41 coatings in a manner to make contiguous perimetric contact with both coatings, such as an edge-overlap on each. As aforementioned, the first 33 and second 41 conductive coatings utilize aqueous base vehicles, whereas the intermediately disposed high resistive coating 39 employs a chemically diverse but compatible base vehicle to prevent a deleterious edge intermixing of coatings during application.

After drying of the three coatings, a continuous bead of sealing frit 21 is applied to the panel-seal edge of the funnel, whereupon a screen-containing viewing panel is positioned. The panel-funnel assembly is then heated in a conventional manner to approximately 450° C. for a suitable period of time, such as substantially 1 hour, to vitrify the sealing frit and effect jointure between the panel and funnel members. The controlled heat of this sealing procedure additionally produces an amorphous transformation of the homogeneous mixture constituting the high resistive coating 39 and effects degasification of the related first 33 and second 41 conductive coatings comprising the tripartite system. At this stage, an electron generating assembly is inserted into the open neck member and hermetically sealed thereto, whereupon the tube structure is subsequently further processed in the conventional manner.

Thus, there is provided a resistive coating means that effects improved internal arc suppression within a cathode ray tube. The coating means is capable of being discretely disposed on the wall of the envelope in an expedient and economical manner during tube manufacturing.

While there has been shown and described what are at present considered the preferred embodiments of the invention, it will be obvious to those skilled in the art that various changes and modifications may be made therein without departing from the scope of the invention as defined by the appended claims.

What is claimed is:

1. An improved high resistive electrical conductive composition formulated for application to a defined area of the interior surface of a cathode ray tube envelope during tube fabrication to provide an amorphous deposition thereon, said resistive composition comprising a homogeneous mixture of:

substantially 35 to 65 weight percent of a particulate amorphous type vitreous substantially insulative frit material compatible with said tube environment and having a softening point in the temperature range of substantially 350° C. to 450° C., said frit material being comprised principally of substantially 70 to 85 weight percent of PbO, 5 to 15 weight percent of $B_2O_3$, 2 to 10 weight percent of $Al_2O_3$, and 3 to 5 weight percent of $SiO_2$, said frit material having a particle size averaging within the range of substantially 1.0 to 35.0 microns;

substantially 65 to 35 weight percent of at least one particulate material selected from the group consisting essentially of cadmium oxide, indium oxide and copper oxide homogeneously admixed with said frit, said metal oxide ingredients having a distribution of particles averaging within the range of substantially 1.0 to 10.0 microns in size;

binder solids within the range of substantially 0.1 to 0.5 weight percent; and solvent means for binder solids, said solvent means being compatible with said tube environment and of a quantity to provide a dispersing medium for said mixture and to impart a viscosity thereto of a value within the range of substantially 150 to 1000 centipoise.

2. The improved resistive composition according to claim 1 wherein said amorphous type vitreous frit material exhibits a softening temperature in the order of substantially 370° C. and comprises substantially 35 to 45 weight percent of said composition and wherein said oxide material is present in substantially 65 to 55 weight percent.

3. The improved resistive composition according to claim 1 wherein said amorphous type vitreous frit material exhibits a softening temperature in the order of substantially 440° C. and comprises substantially 50 to 65 weight percent of said composition, and wherein said oxide material is present in substantially 50 to 35 weight percent.

4. The improved resistive composition according to claim 1 wherein said binder solids are in the form of 1% nitrocellulose dissolved in an ester.

* * * * *